United States Patent [19]

Samuels et al.

[11] Patent Number: 4,709,632

[45] Date of Patent: Dec. 1, 1987

[54] SELECTIVE INTAGLIO INKING DEVICE WITH REMOVABLE CARTRIDGE

[75] Inventors: Gerard Samuels, Paoli, Pa.; Paul R. Smith, Chester, N.J.

[73] Assignee: RCA Corporation, Princeton, N.J.

[21] Appl. No.: 5,808

[22] Filed: Jan. 21, 1987

[51] Int. Cl.[4] ..... B41M 1/10; B41N 1/00

[52] U.S. Cl. ..... 101/163; 101/391; 400/121

[58] Field of Search ..... 101/150, 170, 163, 375, 101/390, 391, 377; 400/121, 125, 125.1

[56] References Cited

U.S. PATENT DOCUMENTS

| | | | |
|---|---|---|---|
| 3,724,370 | 4/1973 | Martin | 101/377 |
| 3,892,174 | 7/1975 | Marcher | 101/35 |
| 4,027,586 | 6/1977 | Hubbard | 101/93.01 |
| 4,288,167 | 9/1981 | Carson, Jr. et al. | 400/121 |
| 4,377,890 | 3/1983 | Miller | 445/38 |
| 4,403,548 | 9/1983 | Faller | 101/372 |
| 4,473,008 | 9/1984 | Heyman | 101/170 |
| 4,515,867 | 5/1985 | Bleacher et al. | 428/204 |
| 4,527,472 | 7/1985 | Davison | 101/377 X |
| 4,530,286 | 7/1985 | Samuels | 101/395 |
| 4,566,384 | 1/1986 | Matsumoto | 101/170 |
| 4,578,570 | 3/1986 | Mazumder et al. | 235/463 |

*Primary Examiner*—Clifford D. Crowder
*Attorney, Agent, or Firm*—E. M. Whitacre; D. H. Irlbeck; L. L. Hallacher

[57] ABSTRACT

The inking bars of an intaglio inking device are mounted in a cartridge which is easily inserted into and removed from the inking device. Adjacent inking bars have different aperture patterns to form an ink path transversely across the inking bars to remove ink from between adjacent bars. A moveable shuttle carries stop bars which can be used to selectively detent the inking bars.

14 Claims, 12 Drawing Figures

SELECTIVE INTAGLIO INKING DEVICE WITH REMOVABLE CARTRIDGE

BACKGROUND

This invention relates generally to inking devices for intaglio printing devices and particularly to such a device having a removeable inking bar cartridge.

Intaglio printing is a technique of printing bar codes on nonporous objects and is well known in the art, as exemplified by U.S. Pat. Nos. 4,473,008 and 4,530,286. Typically in such printing, a smooth inking surface contains a substantially rectangular aperture. A plurality of substantially flat inking bars are stacked together and are arranged along one dimension of the aperture such that the combined thicknesses of the bars substantially fill the aperture. The inking bars include an inking surface which spans the other dimension of the aperture such that the inking surfaces substantially fill the other aperture dimension. The inking bars have a thickness which is determined by the desired width of the bars in the bar code to be printed. The entire inking surface, including the inking edges of the bars, are covered with ink by a mechanical member which drags ink from a reservoir across the inking surface. A squeegee like member is used to remove ink from the printing surface. Prior to inking the inking surface, selected inking bars are depressed to lie a small distance below the inking surface to form cavities between the nondepressed bars. Ink fills the cavities and remains in the cavities after the ink is removed from the inking surface. A nonporous, resilient member is depressed against the inking bars and enters the cavities to transfer the ink from the cavities to the resilient member. The resilient member is removed from the inking surface and brought into contact with the object upon which the bar code is to be printed to effect the transfer of the ink from the resilient member to the item to be identified.

Mechanisms for bar coding nonporous objects in the above-described manner are well known in the art as exemplied by the above-referenced U.S. patents. However, difficulties are encountered because the ink has a tendency to seep between the inking bars, necessitating frequent cleaning of the inking bars and the associated mechanism. Typically, such cleaning requires removal of the inking bars and individually cleaning each of the bars. During such cleaning the inking mechanism is inoperative and cannot be used in the asssembly line. For this reason there is a need for an inking mechanism which is readily removeable from the printing mechanism to minimize the down time of the mechanism during cleaning. There is also a need for a printing bar configuration which enhances the elimination of ink from between the inking bars to prolong the operating time between cleaning periods. There also is a need for an inking bar detenting mechanism which is compact and which minimizes the number of detent actuating means. The present invention fulfills these needs.

SUMMARY

An intaglio inking device includes an inking surface having an aperture and a plurality of separately moveable substantially planar inking bars arranged in the aperture. The inking bars include a flat edge portion which spans one dimension of the aperture and which is moveable between a first position flush with the inking surface and a second position displaced below the inking surface, whereby inking bars in the second position form cavities between inking bars in the first position. A frame member surrounds the inking surface and includes an ink reservoir. The inking device includes means for spreading ink over the inking surface and over the flat edge portions to fill the cavities between the inking bars with ink. The device also includes means for removing ink from the inking surface and the flat edge portions leaving the cavities filled with ink. The inking bars are arranged in a removeable cartridge whereby the inking bars are easily aligned with the inking surface and are separable from the frame member.

FIGS. *7a* and *7b* show printing bar configurations for enhancing the removal of ink from between adjacent bars.

Figure 8:
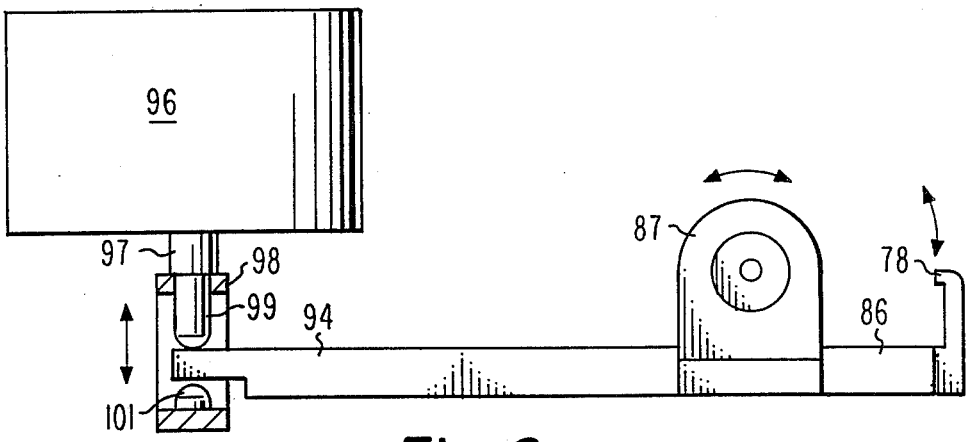

FIG. 8 is a side view of the inking bar moving means.

Figure 9:
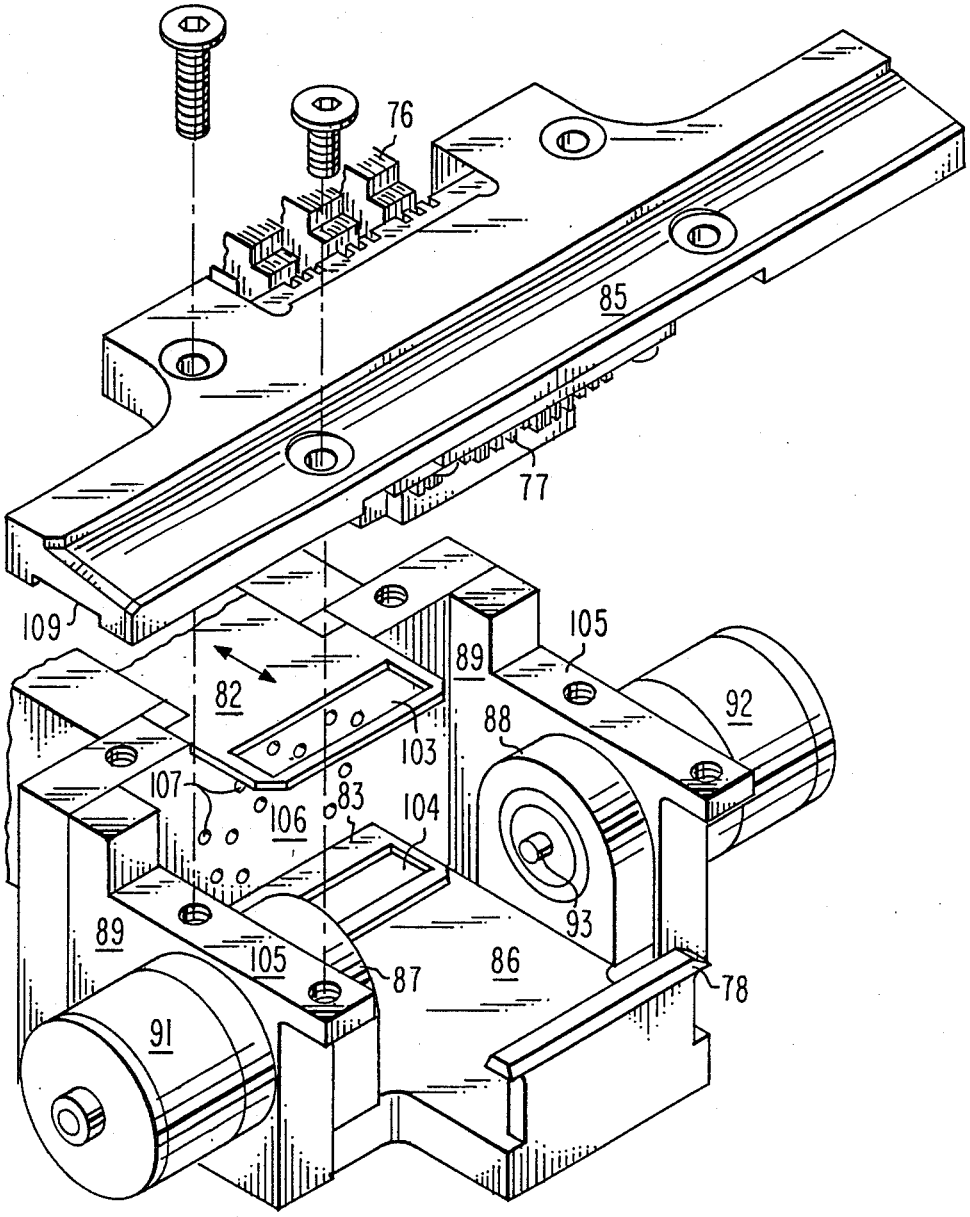

FIG. 9 is an isometric view of the inking bar moving means and bar stop moving means.

Figure 10:
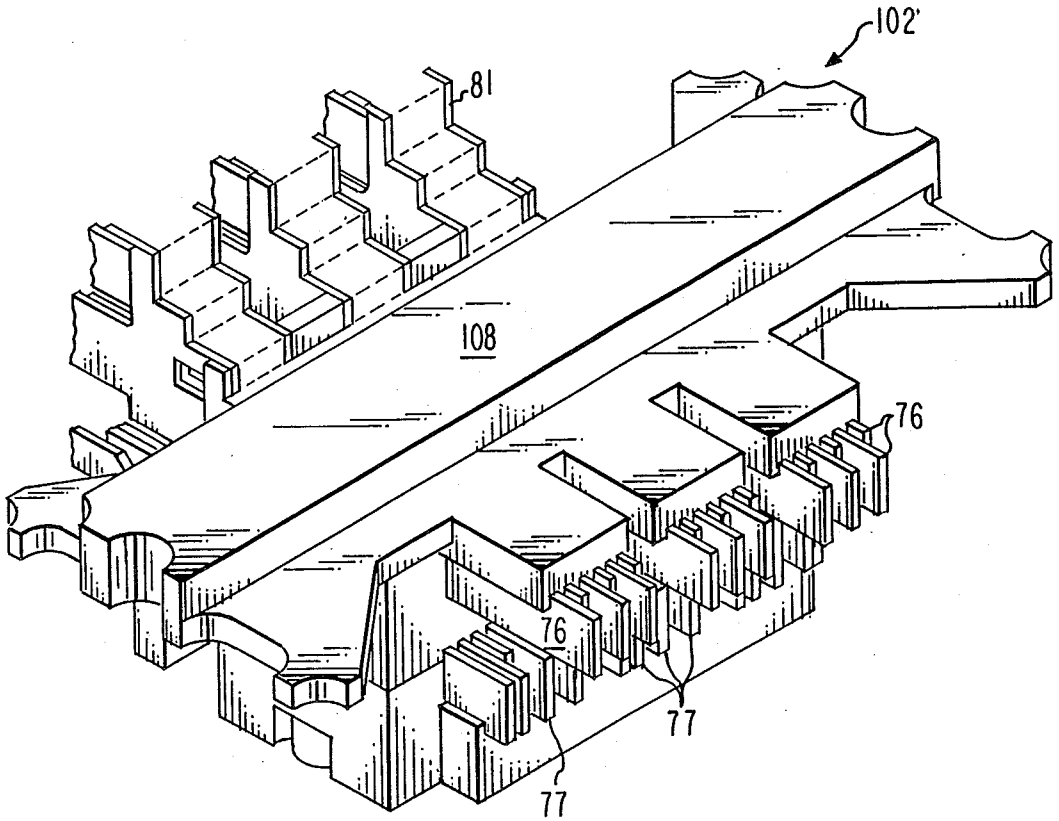

FIG. 10 is an isometric view of the stop bar shuttle.

Figure 11:
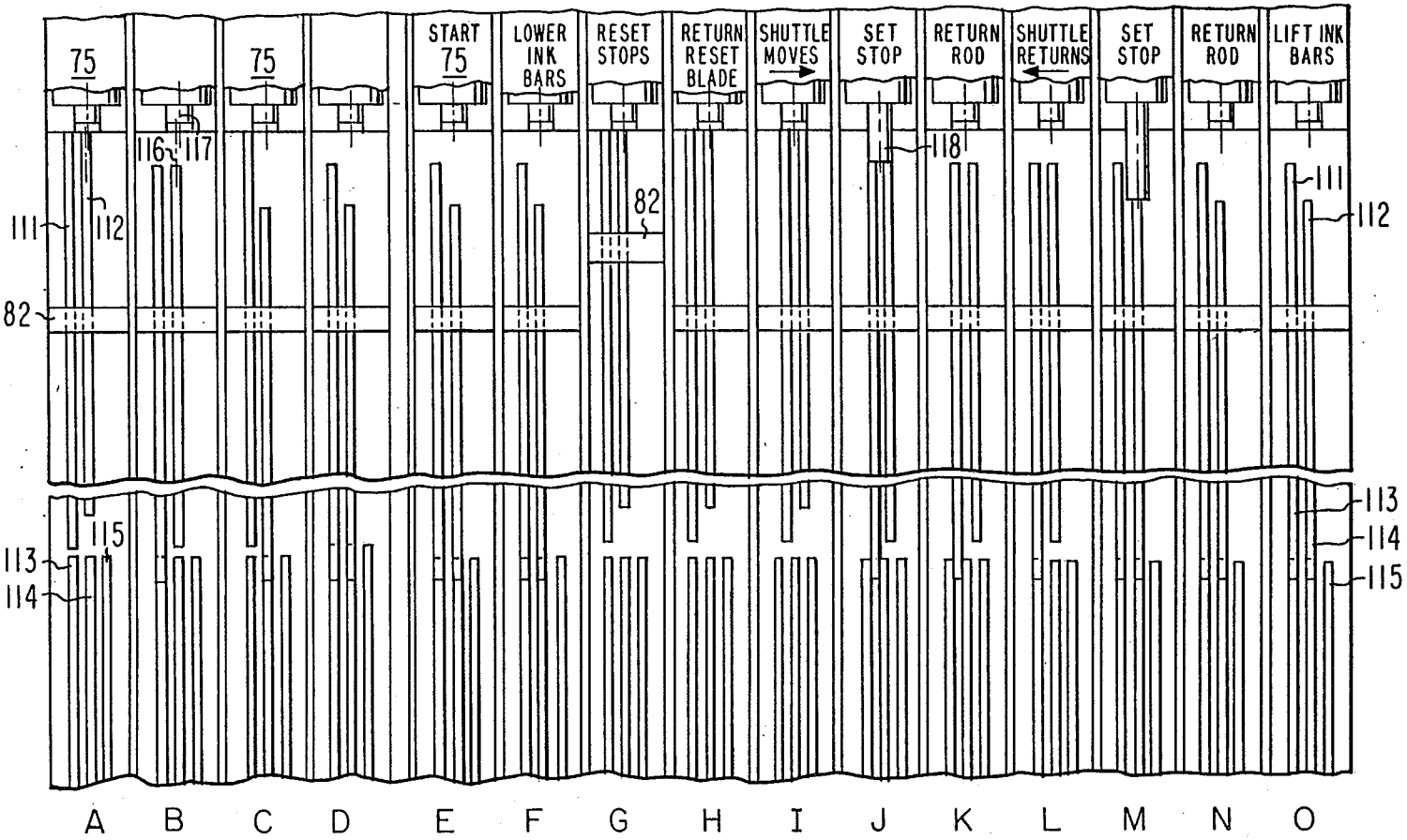

FIG. 11 is a diagram showing how the stop bar shuttle of FIG. 10 detents the inking bars.

DETAILED DESCRIPTION

Figure 1:
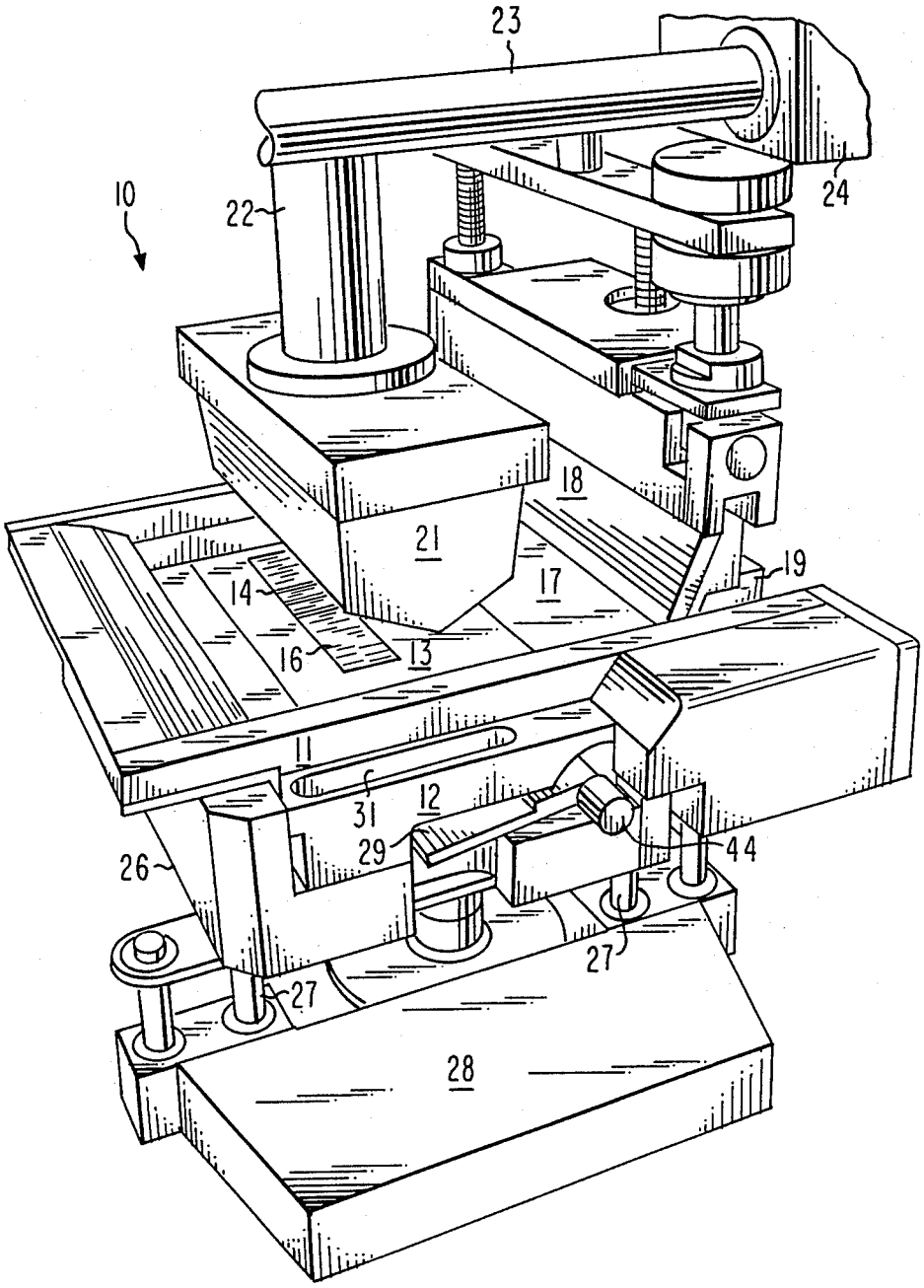
FIG. 1 is an isometric view of an intaglio printing device, including a preferred embodiment of the inventive intaglio inking device.

In FIG. 1, an intaglio printing device 10 includes a frame member 11. The frame member 11 surrounds a removeable cartridge 12 which includes an inking surface 13 having a substantially rectangular aperture 14. A plurality of inking bars 16, shown in detail in FIGS. 5, *7a* and *7b*, are stacked together to fill one dimension of the aperture 14 and span the other dimension of the aperture 14. An ink reservoir 17 is arranged in the proximity of the inking surface 13. An ink spreader 19 has one edge resting in the ink in the reservoir 17, and an ink scraper 18 is arranged in the proximity of the spreader 19. A substantially nonporous ink transfer member 21 is supported above the inking bar 16. The ink transfer member 21 is supported by a vertical shaft 22 to slide between a horizontal shaft 23 and a similar parallel shaft, not shown. The vertical shaft 22 pivots to a horizontal position, by a mechanism, not shown, as the horizontal shaft 23 slides in a support 24. To effect transfer of ink from the inking bars 16, the transfer member 21 is moved downwardly into contact with the inking bars and then retracted upwardly to a preselected height. The shaft 22 and transfer member 21 are rotated to a horizontal position and moved horizontally along the horizontal shaft 23 into contact with the object (not shown) upon which the bar code is to be printed. Typically, when the object upon which a bar code is to be printed is a kinescope faceplate panel, the ink is similar to the frit material which is used to join the faceplate panel and the funnel portion of the kinescope.

The removeable cartridge 12 is held within the frame member 11 by a vertically moveable base 26. The moveable base 26, the frame member 11 and the cartridge 12 are vertically moveable along slide shafts 27 to a fixed base 28. The removeable cartridge 12 includes a handle 29, which is coupled to a shaft 44 to hold the removeable cartridge 12 in alignment with the reservoir 17 within the frame member 11, as shown in detail in FIG. 4. The removeable cartridge 12 includes a finger hole 31 to assist in removing the cartridge from the mechanism.

Briefly stated, when it is desired to remove the removeable cartridge 12 from the intaglio printing device 10, the moveable base 26, along with the removeable cartridge 12 and frame member 11, are moved downwardly into contact with the fixed base 28. The handle 29 is rotated upwardly to uncouple the removeable cartridge 12 from the moveable base 26 and the cartridge can be grasped by the finger aperture 31 and slid horizontally from the moveable base 26. A clean cartridge can be inserted into the moveable base 26 and raised vertically into the inking position and printing continued. The removed cartridge can then be cleaned at leisure while the printing continues with the clean replacement cartridge.

Figure 2:
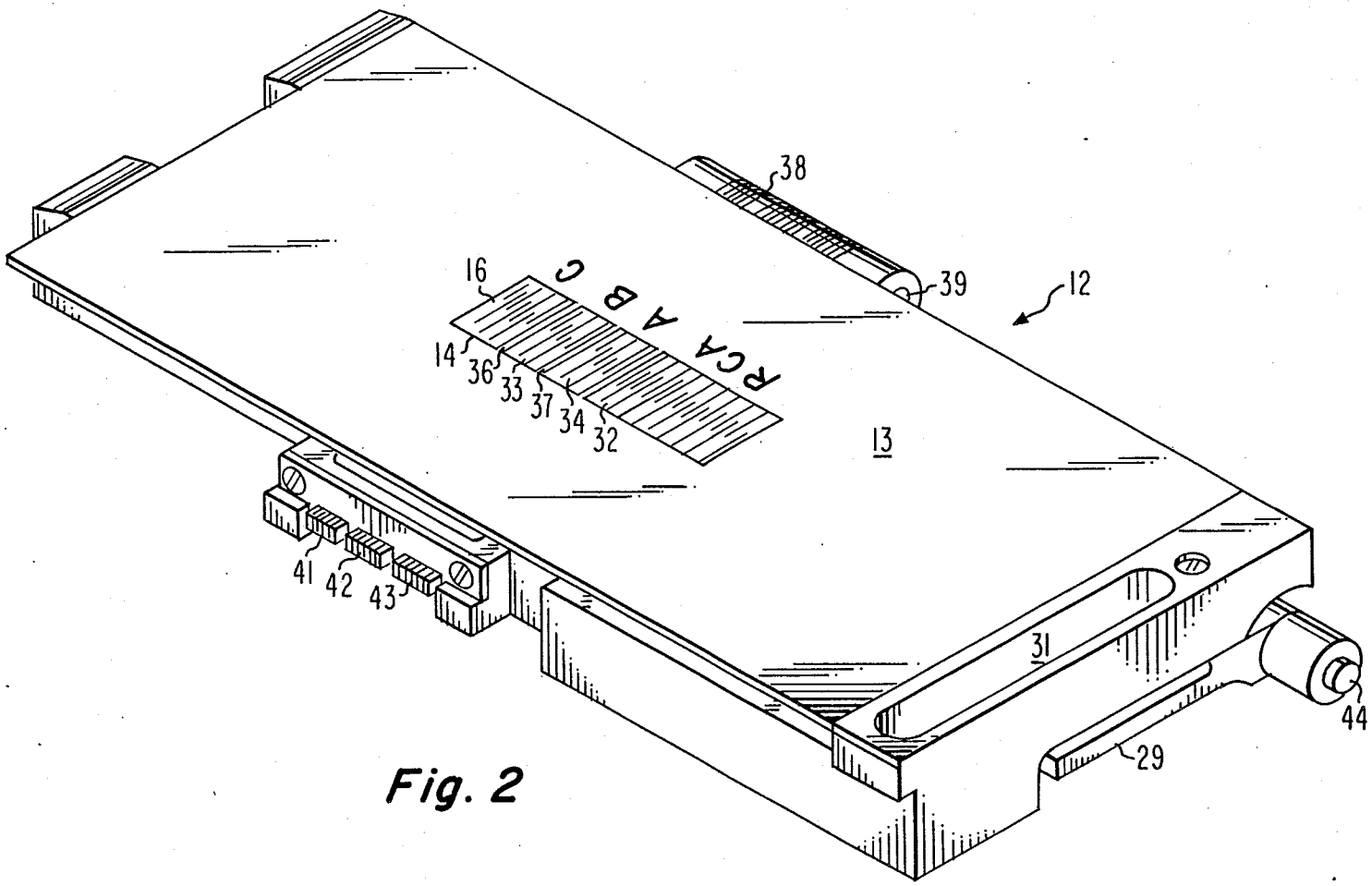
FIG. 2 is an isometric view of the removeable cartridge including the inking surface and inking bars.

In FIG. 2, the printing surface 13 is provided with a set of inking cavities 32 which can be used to represent permanent coding to be printed, for example, the letters RCA. However, the permanent identification can be replaced with moveable inking bars to increase the number of changeable code digits. In addition to the aperture 14, the printing surface 13 includes additional apertures 33 and 34, with the apertures separated by metal bars 36 and 37 which are integral with, and flush with, the inking surface 13. One end 38 of the inking bar stacks is rotatably mounted on a shaft 39. The other ends 41, 42 and 43 of the inking bar stacks are supported a desired distance beneath the printing surface 13.

Figure 3:
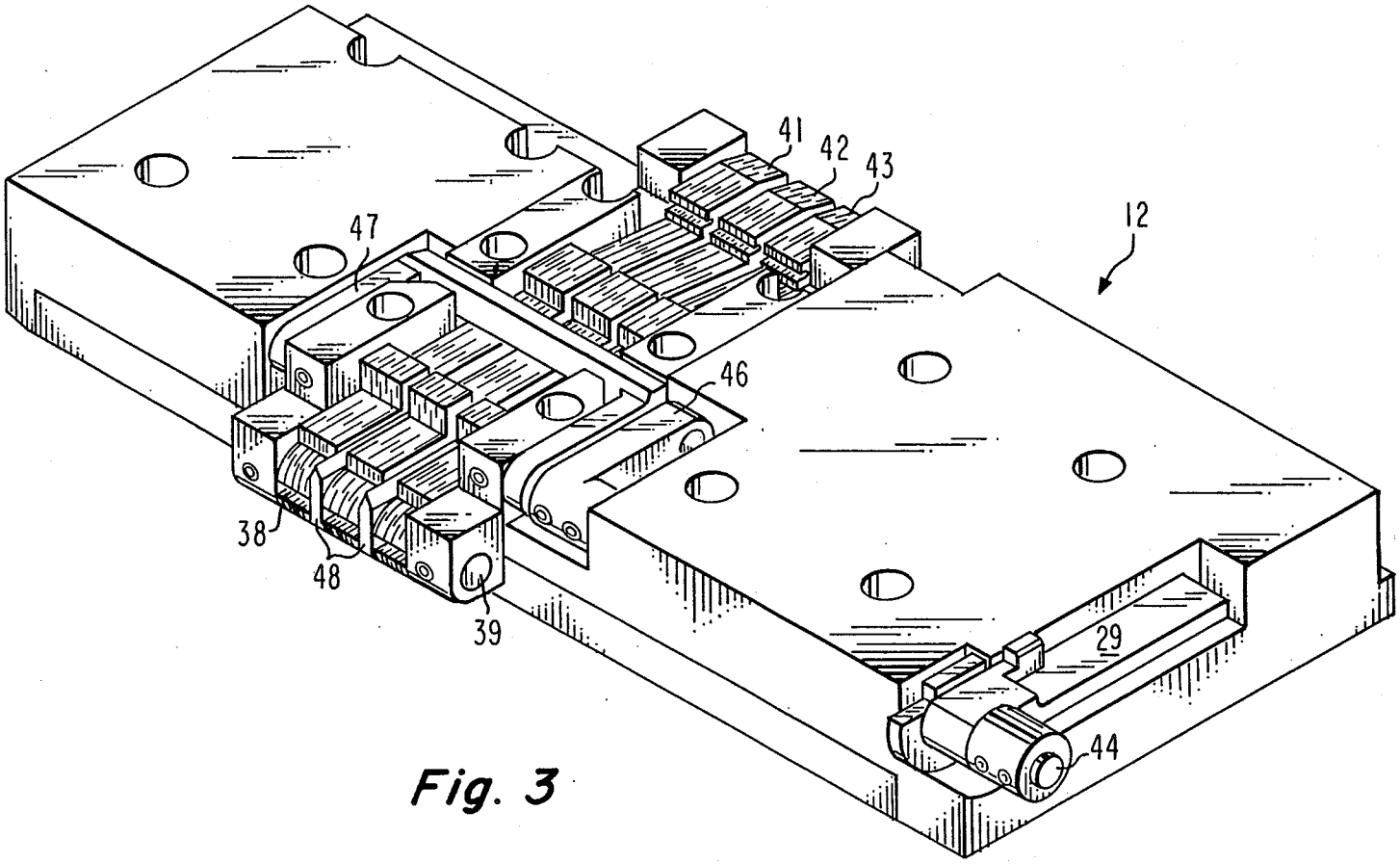
FIG. 3 is an isometric view of the bottom portion of a preferred embodiment of the inventive cartridge.

FIG. 3 shows the bottom side of the removeable cartridge 12. The handle 29 is fixed to a rotatable shaft 44. A crank 46 is also fixed to the shaft 44. The crank 46 engages a U-shaped bridge member 47 which holds the stacks 41, 42 and 43 of inking members in position, and which also rotates on the shaft 44. The stacks 41, 42 and 43 of inking bars are rotatable on the shaft 39. To remove the inking bars from the cartridge 12, the handle 29 is rotated counterclockwise to simultaneously rotate the bridge member 47 away from the stacks of inking bars. The inking bars are then free and can be rotated on the shaft 39 and removed from the mechanism for cleaning purposes. The stacks 41, 42 and 43 of inking bars are separated by guide members 48.

Figure 4:
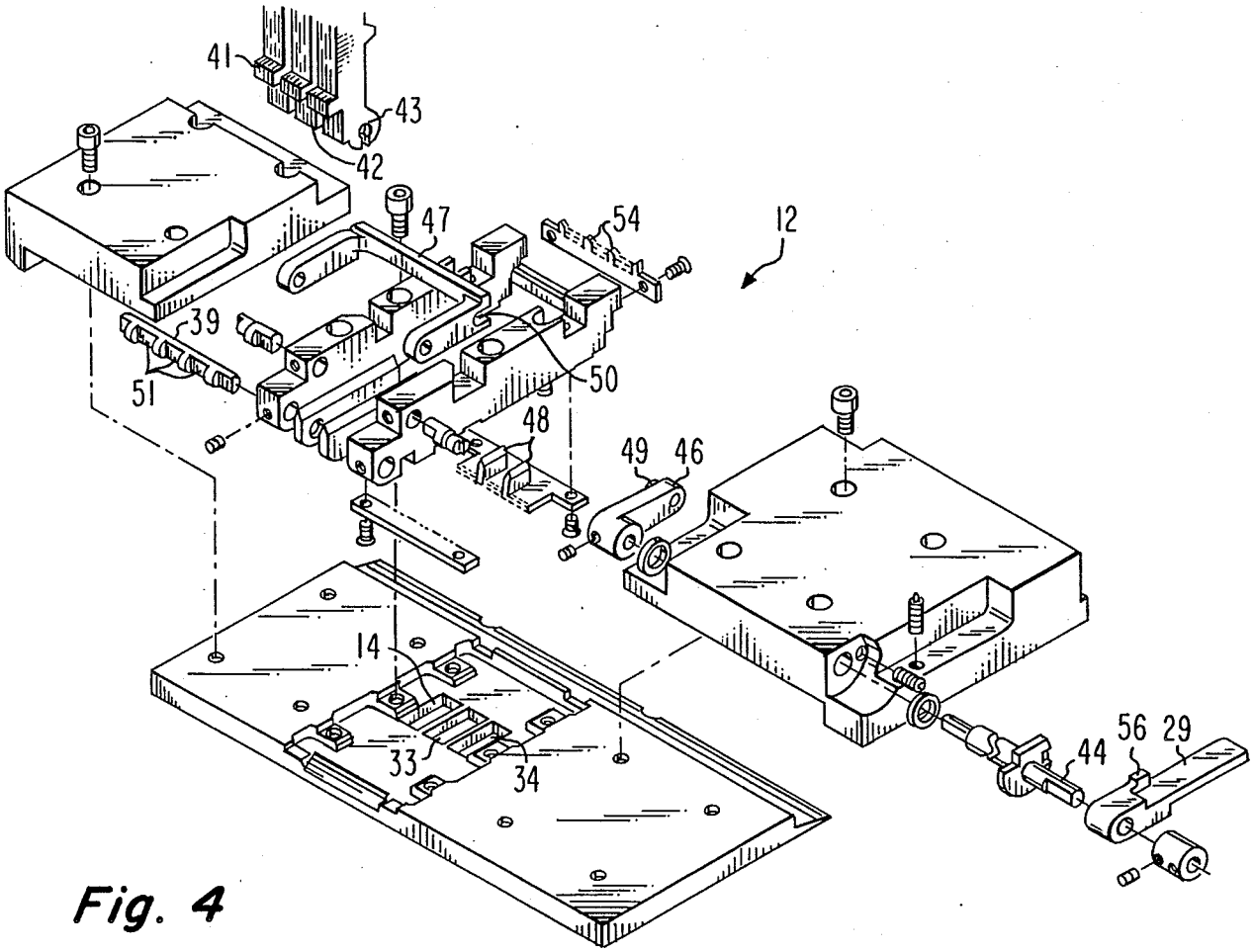
FIG. 4 is an exploded view of a preferred embodiment of the inking cartridge.

FIG. 4 is an exploded view of the removeable cartridge 12 showing the major components of the cartridge 12. The crank 46 includes a nipple 49 which engages a slot 50 in the U-shaped bridge 47. The shaft 39, which rotatably supports the inking bars 16, includes flattened portions 51 on both sides of the shaft. The handle 29 includes a nipple 56 which rests in a slot (not shown) in the moveable base 26 to retain the cartridge 12 in the base. Rotation of the handle 29 removes the nipple 56 from the slot to remove the cartridge from the base 26.

In FIGS. *7a* and *7b*, the inking bars 16 include slots 52 which communicate with round holes 53. The diameter of the holes 53 is substantially equal to the diameter of the shaft 39. Also, the width of the slots 52 is substantially equal to the thickness of the flattened portions 51 in the shaft 39. Accordingly, the inking bars 16 are mounted onto the shaft 39 by slipping the slots 52 over the flattened portions 51. After the inking bars are rotated into position, and during inking, they are closely held to the shaft 39 by the holes 53. Additional guides 54 (FIG. 4) separate the free ends of the stacks 41, 42 and 43 of the inking bars 16.

Figure 5:
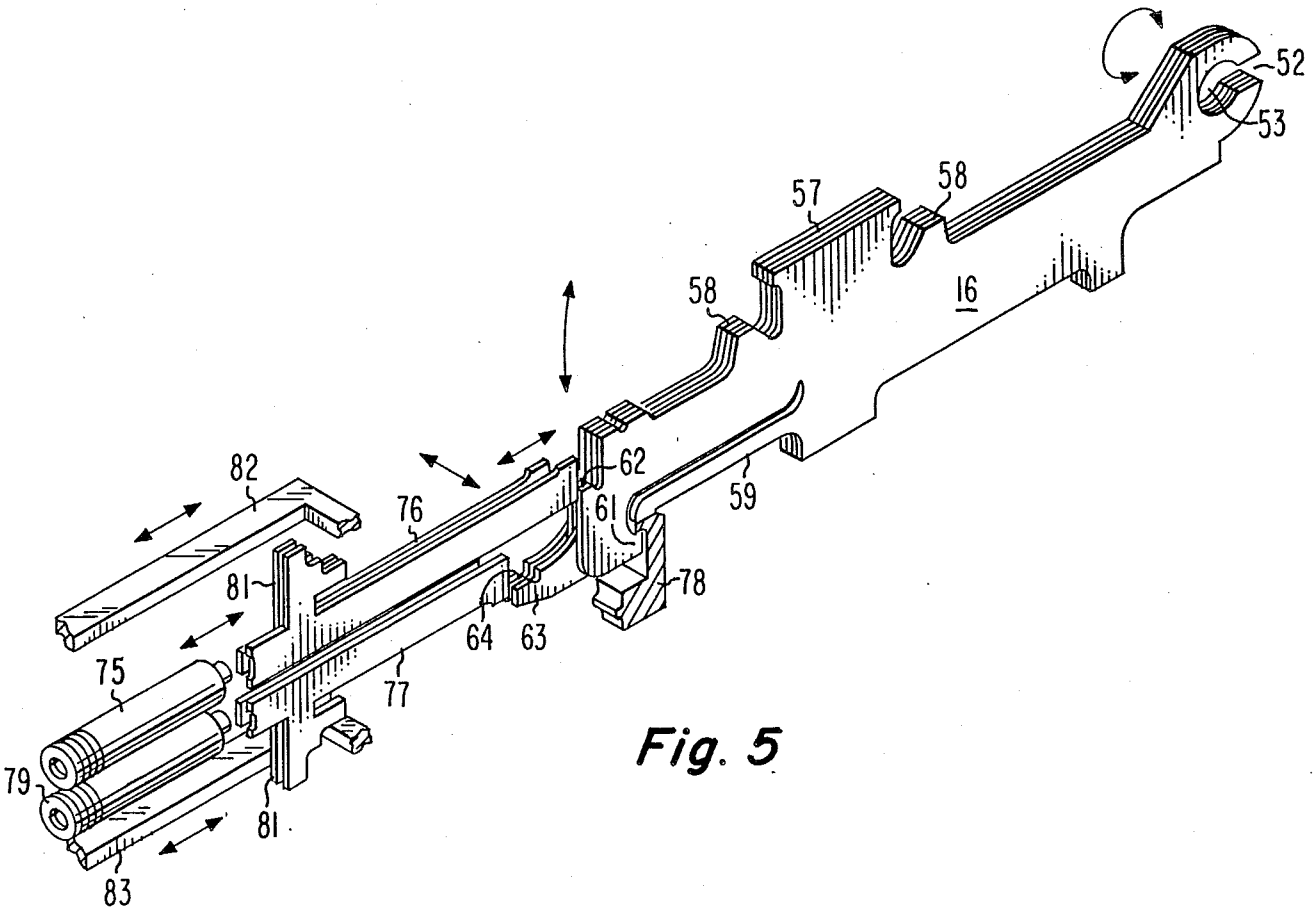
FIG. 5 is an isometric view of the inking bars showing the relationship of the inking bars and stop bars and actuating members.
Figure 6:
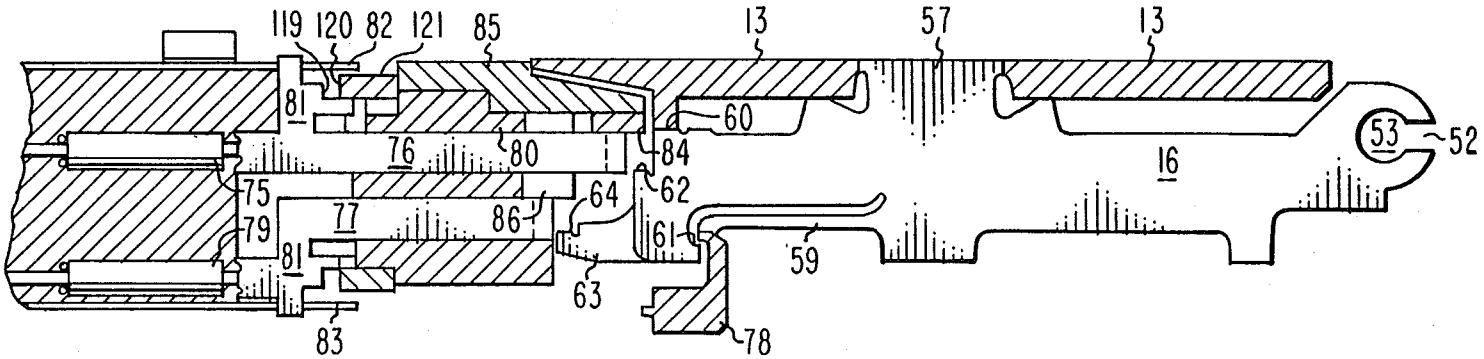
FIG. 6 is a cross section of the inking bar, stop bar and actuating means.
Figure 7A:
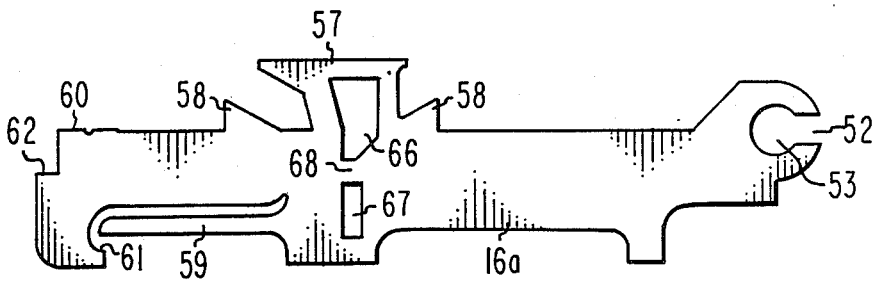
Figure 7B:
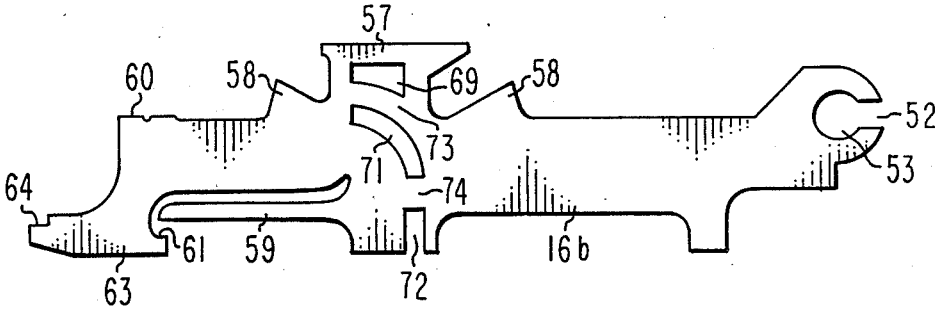

FIGS. *7a* and *7b* show two slightly different configurations of inking bars **16*a* and 16*b*, respectively. The inking bars are substantially planar and are substantially similar. The inking bars 16*a* and 16*b* include flat edge portions 57. The flat edge portions 57 span the aperture 14, 33 and 34 in the inking surface 13. The inking bars 16*a* and 16*b* are alternately stacked so that each of the stacks substantially fills the other dimension of the apertures 14, 33 and 34 in the inking surface 13. Both the inking bars 16*a* and 16*b* include triangular portions 58 to cause excess ink to flow toward aperture patterns within the inking bars. The inking bars 16*a* and 16*b* include a cantilevered spring 59 which is pressed to move the inking bar between inking and noninking positions, as explained hereinafter. The surface 60 of the inking bars 16*a* and 16*b* serves as a reference surface to assure that the flat edge portion 57 is flush with the inking surface 13. The inking bars 16*a* and 16*b* also include a lip 61 which is engaged to move the bars between the inking and noninking positions, also as explained hereinafter. The inking bar 16*a* includes a detent surface 62, which is used to maintain the bar in an inking position. The inking bar 16*b* includes an extension portion 63 having a detent surface 64, which maintains the inking bar in an inking position. Accordingly, as shown in FIGS. 5 and 6, the detent surfaces 62 and 64 are vertically spaced when the inking bars 16*a* and 16*b* are stacked together. Additionally, the detent surfaces 62 and 64 are horizontally displaced so that different lengths of stop bars can be used. The inking bar 16*a* includes apertures 66 and 67 separated by a metal portion 68. The inking bar 16*b* includes apertures 69, 71 and 72 separated by metal portions 73 and 74. The aperture 72 communicates with the lower edge of the inking bar 16*b*. The apertures 66, 67, 69, 71 and 72 are configured, dimensioned and located so that the metal portions 68, 73 and 74 between the apertures of one inking bar overlap the apertures of the other inking bar. The two groups of apertures in the two inking bars 16*a* and 16*b* thus form a path transversely across the inking bars to facilitate the flow of ink between the bars, to thereby substantially decrease the accumulation of ink between the bars and thus to substantially decrease the need for frequent cleaning of the bars. The aperture 72 allows excess ink to drop from the inking bar into a reservoir, not shown. The triangular portions 58 of the inking bars 16*a* and 16*b* direct excess ink toward the aperture patterns within the bars. The triangular portions 58** facilitate the flow of ink between the bars and also assist in preventing the flow of ink along the top surfaces of the bars toward other portions of the mechanism, thereby further enhancing the removal of ink from the bars and decreasing the sticking together of adjacent bars.

In FIGS. 5 and 6, the detent surfaces 62 of the inking bars **16*a* are in substantial alignment with upper stop bars 76. The detent surfaces 64 of the inking bars 16*b* are in substantial alignment with lower stop bars 77. An actuating bar 78 is arranged to move bilaterally vertically to engage the cantilever springs 59 of all the inking bars simultaneously. Additionally, the actuating bar 78** is configured to engage the lip 61 of all the inking bars 16 during movement in the downward direction. When the actuating bar 78 pulls the inking bars 16 downwardly by engaging the lip 61, the stop bars 76 and 77 are slightly above the detent surfaces 62 and 64 respectively. Also, the flat edge portions 57 are displaced downwardly a small distance from the inking surface 13. Bars which are not to be moved upwardly into alignment with the inking surface 13 are held in the downward position by the appropriate stop bars 76 and 77. The upper stop bars 76 are horizontally moveable by first moving means 75, which are shown as cylinders. Similarly, the lower stop bars 77 are horizontally moveable by similar cylinders 79. Actuation of the cylinders 75 and 79 moves the stop bars 76 and 77 horizontally into engagement with the detent surfaces 62 and 64. Upward motion of the actuating bar 78 causes the bar to act against the cantilever spring 59 of all inking bars. For bars which are prohibited from movement by a stop bar 76 or 77, the cantilever springs flex and the bars do not move. However, bars which are intended to be in alignment with the inking surface 13 are pressed upwardly by the actuating bar 78 and the bars slightly rotate on the shaft 39 (FIG. 4), which passes through the circular hole 53, to move the flat edge portions 57 into alignment with the inking surface 13. The upper stop bars 76 include arms 81, arranged at right angles to the lengths of bars, which engage second horizontal motion means, such as a reset bar 82. The lower stop bars 77 are identical to the upper stop bars 76, except they are shorter in length, and include right angle arms 81 which face downwardly. These arms are engaged by second horizontal motion means, such as a reset bar 83. The reset bars 82 and 83 are simultaneously actuated at the distal end, not shown, and move toward the left to engage the arms 81 and move the stop bars 76 and 77 from engagement with the detent surfaces 62 and 64, respectively. In FIG. 6, the ends of the upper stop bars 76 ride on hardened surfaces 84 to decrease wear on the device. Similarly, the ends of the lower stop bars 77 ride on hardened surfaces 86 to decrease wear on the device.

FIG. 9 shows the mounting of the actuating bar 78 in detail. The actuating bar 78 is fixed to a lever arm 86 and bearing flanges 87 and 88. The bearing flanges 87 and 88 are rotatable with respect to side supports 89. Shuttle actuating cylinders 91 and 92 are supported by the two side supports 89. The cylinder 92 has a shaft 93 which is coaxial with the pivot point of the bearing flange 88. The cylinder 91 has a similar shaft, not shown. An upper plate 85 is arranged above the upper stop bars 76 and the lower stop bars 77.

The reset bars 82 and 83 include apertures 103 and 104, respectively. The apertures 103 and 104 engage the right angle arms 81 (FIG. 6) of the upper and lower stop bars, respectively, to move the stop bars from engagement with the detent surfaces 62 and 64. The reset bars 82 and 83 are simultaneously moved by a cylinder, not shown.

In FIG. 8, the lever arm 86 includes a distal end 94. A cylinder 96 is arranged above the end 94. A shaft 97 of the cylinder 96 supports a coupling 98 including two bumpers 99 and 101. When the cylinder 96 is actuated to extend the shaft 97 downwardly the bumper 99 acts against the end 94 and causes the actuator bar 78 to move upwardly against the cantilever springs 59 of the inking bars. When the shaft 97 is extracted into the cylinder 96, the actuating bar 78 moves downwardly to engage the lips 61 of the inking bars 16 to pull the flat edge portions 57 from alignment with the inking surface 13.

In FIG. 10, the stop bars 76 and 77 are arranged in a shuttle 102 to maintain the alignment of the stop bars 76 and 77. The shuttle 102 is placed between the shafts 93 of the cylinders 91 and 92 to slideably rest on the top surfaces 105 of the side supports 89. An upper portion 108 of the shuttle 102 rests within a slot 109 (FIG. 9) in the upper plate 85. Actuation of the cylinders 91 and 92 causes the shuttle 102 to slide on the surfaces 105 of the side supports 89. The arms 81 of the stop bars 76 and 77 lie within the apertues 103 and 104 in the stop bar reset bars 82 and 83, respectively. The cylinders 75 and 79 are mounted in apertures 107 within a faceplate 106 which is affixed to the supports 89. The shuttle 102 (FIG. 10) is thus slideable with respect to the actuating cylinders 75 and 79 and the inking bars 16. Accordingly, half as many cylinders are needed as there are stop bars. This is so because after the stop bars are actuated to detent some of the inking bars 16, the cylinder 91 is actuated to slide the shuttle 102 on the top surfaces 105 of the side bars 89, perpendicular to the inking bars 16 to change the alignment of the stop bars 76 and 77 with the cylinders 75 and 79 and the inking bars 16.

FIG. 11 shows a series of diagrams A to O which are useful in understanding the operation of the shuttle 102 and the detenting of the inking bars 16. In all the diagrams A to O, the same two top stop bars 111 and 112 are shown and the same three inking bars 113, 114 and 115 are shown. The inking bars 113, 114 and 115 are exemplary of the type shown in FIG. *7a*. The inking bars shown in FIG. *7b* are detented by the lower stop bars and, would lie between the inking bars 113, 114 and 115. The lower stop bars 77, the inking bars which they detent, and the lower cylinders 79 are not shown for simplicity. However, the detenting operation of the lower stop bars 77 is identical to that of the upper stop bars 76.

Diagrams A to D show the four possible positions for the upper stop bars 111 and 112 at the end of any inking operation. The stop bar 111 is longer than the stop bar 112. Also, stop bar 111 is aligned with inking bar 113 and the stop bar 112 is aligned with the inking bar 114. Also, in diagrams A to D the center line 116 of stop bar 112 is displaced from the center line 117 of the cylinder 75, by a preselected distance, such as 0.006 inches.

Diagram A shows the position of the stop bars 111 and 112 when neither inking bar 113 nor 114 is detented. Diagram B shows the stop bars 111 and 112 when only inking bar 113 is detented. Diagram C shows the stop bars 111 and 112 when only inking bar 114 is detented. Diagram D shows stop bars 111 and 112 when both inking bars 113 and 114 are detented.

Diagram E is identical to diagram D and serves as the starting diagram for understanding the coding of the inking bars 16. Diagram F is identical to diagram E but all the inkings are lowered as the first step of coding all the inking bars 16, this is accomplished by actuating the actuating bar 78 (FIG. 9) to engage the lip 61 (FIGS. *7a* and *7b*) of all the inking bars 16. Diagram G shows resetting the stop bars 111 and 112. In this operation, reset bars 82 and 83 (FIG. 9) are actuated to engage the arms 81 (FIG. 5) of the stop bars 76 and 77 to disengage all the stop bars 76, including bars 111 and 112 from engagement with the inking bars 16. The stop bars 111 and 112 are then in the position shown in diagram H, and the reset bars 82 and 83 are returned to the normal position. Diagram I shows the stop bars 111 and 112 both in alignment with the shaft of the cylinder 75. Previously, stop bar 111 was not aligned with the shaft of the cylinder. The alignment is affected by actuating cylinder 91 (FIG. 9) to slide the shuttle 102 with respect to the cylinders 75 by a predetermined displacement, such as 0.031". Diagram J shows the actuation of the cylinder 75 to horizontally move the stop bars 111 and 112. Stop bar 111 is longer then stop bar 112 and slides between, and slightly above, the inking bars 113 and 114, while previously this stop bar was aligned with the inking bar 113. Also in diagram J, stop bar 112 is no longer in alignment with the inking bar 114 and is in alignment with, and slightly above, the space between the inking bars 114 and 115. In diagram K, the shaft of the cylinder 75 is returned to the unactuated position. In diagram L, the shuttle 102 is returned to the original position by actuation of cylinder 92 (FIG. 9) and by returning the shaft of cylinder 91 to the normal position. The stop bars 111 and 112 are again in alignment with the inking bars 113 and 114, respectively. Additionally, the stop bar 111 is no longer in alignment with the shaft of the cylinder 75. In diagram M, the cylinder 75 is again actuated to further horizontally slide the stop bar 112 into alignment with the inking bar 114 and above the detent surface 62 (FIG. 5 and *7a*), should the cylinder 75 jam with the shaft extended, as shown in diagram M, horizontal movement of the shuttle would cause the shaft to act against the stop bar 111 and bend the bar. This is avoided because the reset bar 82 is moved prior to the shuttle and the stop bar 112 will push the jammed shaft back into the cylinder 75. In diagram N, the shaft in the cylinder 75 is returned to the original position and the ends of the stop bars 111 and 112 rest immediately above detent surfaces 62 (FIGS. 5 and 6). Both of the inking bars 113 and 114 are then detented and when the actuating bar 78 (FIG. 9) is raised to put all undetented inking bars into the non-inking position, as shown in diagram O, the inking bars 113 and 114 remain displaced from the inking surface 13.

In diagrams J and M of FIG. 11 the shaft 118 of the cylinder 75 moves different distances. This can be understood from FIG. 6. In FIG. 6, the arm 81 of the stop bar 76 includes a detent surface 119. Also, a detent 121 has a vertical detent surface 120. When the stop bar 76 is a long bar, such as bar 111 of FIG. 11, actuation of the cylinder causes the horizontal sliding of the stop bar 111 until the detent surface 119 of the arm 81 engages the detent surface 120 of the detent 121. This results in a displacement similar to that illustrated in diagram J of FIG. 11. The detent surfaces equivalent to the surfaces 119 for the shorter stop bars, such as 112, are horizontally displaced toward the cylinder 75 by a distance equal to the required additional motion of the stop bars. Accordingly, detenting for stop bars of this type results in the shaft 75 moving an additional distance to bring the stop bar such as 112 into engagement with the detent surface 62 of the stop bar 16. Accordingly, the limited motion of the shaft 118 illustrated in diagram J of FIG. 11 is affected by jamming the detent surface 119 against the detent surface 120, rather than by trying to control the stroke of the cylinder 75.

After the undetented inking bar is raised so that the inking edges 57 (FIG. 6) are in alignment with the inking surface 13, ink is spread over the inking surface 13 to fill the cavities created between the undetented inking bars, and the ink in the cavities is transferred from the cavities to the ink transfer member 21 (FIG. 1). The inking bars 111 and 112 are then in a position illustrated in diagram D of FIG. 11 and the detenting process described with respect to diagrams E to O is repeated for the next desired detenting sequence.

What is claimed is:

1. In an intaglio inking device including an inking surface having an aperture, a plurality of separately moveable substantially planar inking bars arranged in said aperture, each inking bar having a substantially flat edge portion spanning one dimension of said aperture, and moveable between a first position flush with said inking surface and a second position displaced from said inking surface whereby inking bars in said second position form cavities between inking bars in said first position, a frame member surrounding said inking surface and including an ink reservoir, means for spreading ink over said inking surface and said flat edge portions to fill said cavities with ink, means for removing ink from said inking surface and said flat edge portions leaving said cavities filled with ink, means for moving said inking bars between said first position and said second position, improvements wherein:

said inking bars are arranged in a removeable cartridge whereby said inking bars are alignable with and separable from said support member and from said means for moving;

and wherein said inking bars include a detent surface, said inking device further including stop bars for selectively engaging said detent surfaces whereby engaged inking bars are detented in said first position, first moving means for individually engaging said stop bars with said detent surfaces, second moving means for disengaging said stop bars from said detent surfaces, said stop bars being movably supported between said first moving means and said inking bars whereby said stop bars are moveable in a direction substantially normal to said inking bars, and said first moving means can each be effective in detenting two of said inking bars.

2. The intaglio inking device of claim 1 wherein said inking bars include cantilever springs, said means for moving said inking bars acting against said cantilever springs.

3. The intaglio inking device of claim 2 wherein adjacent inking bars include different aperture patterns, the apertures of said patterns overlapping to form an ink path between adjacent bars.

4. The intaglio inking device of claim 3 wherein alternate inking bars include extension portions, said extension portions including said detent surface whereby the detent surfaces of adjacent inking bars are vertically spaced.

5. The intaglio inking device of claim 4 wherein said first moving means are cylinders, said cylinders being vertically stacked to engage said stop bars.

6. The intaglio inking device of claim 5 wherein said inking bars are stacked in a plurality of groups whereby each group represents a selected code.

7. The intaglio inking device of claim 1 wherein alternate inking bars include extension portions, said extension portions including said detent surface whereby the detent surfaces of adjacent inking bars are vertically spaced.

8. The intaglio inking device of claim 7 wherein said first moving means are cylinders, said cylinders being vertically stacked to engage said stop bars.

9. The intaglio inking device of claim 8 wherein adjacent inking bars include different aperture patterns, the apertures of said patterns overlapping to form an ink path between adjacent bars.

10. The intaglio inking device of claim 9 wherein said inking bars further include triangular portions for directing ink toward said apertures.

11. The intaglio inking device of claim 1 wherein adjacent inking bars include different aperture patterns, the apertures of said patterns overlapping to form an ink path between adjacent bars.

12. The intaglio inking device of claim 11 wherein said inking bars further include triangular portions for directing ink toward said apertures.

13. In an intaglio inking device having a plurality of substantially flat inking bars stacked in a closely spaced relationship, and separately moveable between a first inking position and a second non-inking position whereby bar codes are formed by selectively moving said inking bars into said first and second positions, an improvement wherein:

adjacent inking bars have different first and second aperture patterns, the apertures in said first and second patterns being different and being configured whereby metal portions between the apertures in one pattern overlap the apertures in the other pattern, at least one aperture in one of said patterns communicating with an edge of said inking bar, said apertures in said first and second patterns forming an ink path transversely across said inking bars whereby ink is removed from between said inking bars along said ink path.

14. The improvement of claim 13 wherein said inking bars further include triangular portions for directing ink toward said apertures.

* * * * *